United States Patent [19]

Edgcombe

[11] 4,049,995

[45] Sept. 20, 1977

[54] RESONANT CAVITY TUBES

[75] Inventor: Christopher John Edgcombe, Coton, England

[73] Assignee: English Electric Valve Co., Ltd., England

[21] Appl. No.: 683,780

[22] Filed: May 6, 1976

[30] Foreign Application Priority Data

May 7, 1975 United Kingdom ..... 19083/75

[51] Int. Cl.[2] ..... H01J 25/10

[52] U.S. Cl. ..... 315/5.39; 315/5.51; 315/5.52; 333/83 R

[58] Field of Search ..... 315/5.39, 5.51, 5.52; 333/83

[56] References Cited

U.S. PATENT DOCUMENTS

| | | | |
|---|---|---|---|
| 2,413,364 | 12/1946 | McCarthy | 315/5.52 |
| 2,904,719 | 9/1959 | Pearce et al. | 315/5.52 X |
| 3,390,301 | 6/1968 | Sawada et al. | 315/5.51 X |
| 3,509,413 | 4/1970 | Schmidt | 315/5.51 X |

*Primary Examiner*—Saxfield Chatmon, Jr.
*Attorney, Agent, or Firm*—Diller, Brown, Ramik & Wight

[57] ABSTRACT

A klystron cavity is modified to raise its resonant frequency. The central portion of one end wall of the cavity is set back from the other end wall to reduce the capacitance between the central portion and the drift tube projecting from the other wall. A central portion of the other end wall may also be set back if required.

7 Claims, 2 Drawing Figures

RESONANT CAVITY TUBES

This invention relates to resonant cavity tubes and in particular to klystron tubes.

Figure 1:
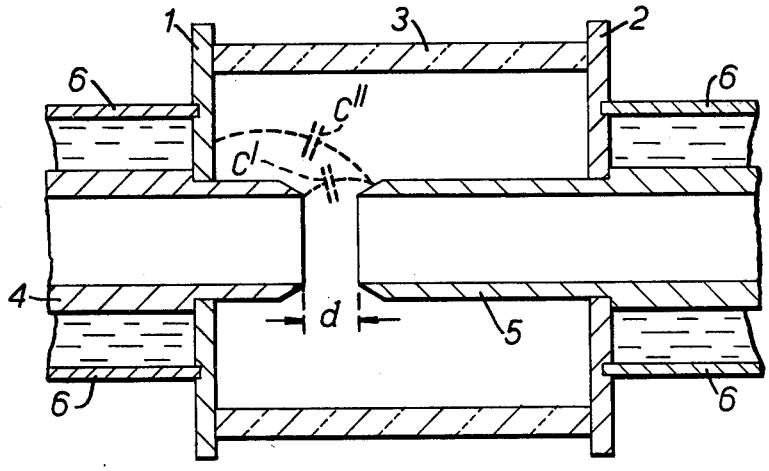

The conventional construction of the resonant cavity portion of a known klystron tube is illustrated in FIG. 1 of the accompanying drawing. Part of the resonant cavity of the tube is formed by end walls 1 and 2 separated by a ceramic tube 3. A drift tube portion 4 extends through end wall 1 into the vacuum chamber formed by the walls 1 and 2 and the ceramic cylinder 3. A further drift tube portion 5 extends through end wall 2 towards the end of the drift tube portion 4. The two ends of the drift tube portions 4 and 5 are spaced from one another by a distance *d*.

This particular klystron is of the external cavity type, so called because it is provided to have a resonator box (not shown) fitted around the ceramic cylinder 3.

A water jacket 6 is provided for cooling purposes, the coolant therein being capable of contacting the outsides of the drift tube portions 4 and 5 and parts of the end walls 1 and 2.

The resonant frequency of the klystron is determined by the dimensions of the aforementioned externally fitted resonator box (not shown) and also by the capacitance between the opposite ends of the chamber formed by the end walls 1 and 2, and in particular by the capacitance between the ends of the drift tube portions 4 and 5 projecting through the end plates 1 and 2. The capacitance to any element of area P on one drift tube portion 5 may be considered as made up of a contribution $c'$ from the end of the opposite drift tube portion 4 plus a contribution $c''$ from the face of the opposite end wall 1.

In the design of a complete klystron it is often desirable to limit the maximum separation between the ends of the drift tube portions 4 and 5, whilst at the same time ensuring that the klystron will operate at a specified upper frequency. These two requirements are in conflict, since as the separation *d* between the ends of the drift tube portions 4 and 5 is reduced, the overall resonant frequency of the klystron is also reduced.

The present invention seeks to reduce this difficulty.

According to this invention, a resonant cavity tube comprises two spaced cavity forming walls through one of which a first drift tube portion extends and through the other of which a second drift tube portion extends, said two drift tube portions extending towards one another to end within the cavity of which said walls form part, and wherein at least said one of said walls is formed so that one part of said one wall is spaced further from the end of said second drift tube portion than another part of said one wall.

Preferably said one part of said one wall is a part through which passes said first drift tube portion.

Preferably said one and another parts of said one wall are discreet wall portions which are united by an extension of a coolant jacket surrounding said first drift tube portion.

Said resonant cavity tube may be of the external cavity type or of the integral cavity type wherein the cavity defined by said cavity forming walls comprises the total extent of the resonant cavity volume in that part of the tube. Where the resonant cavity tube is of the external cavity type, preferably a dielectric cylinder extends between said two walls to form a vacuum chamber which is provided to couple with a resonator box fitted around said cylinder as known per se. As known per se, preferably said dielectric cylinder is a ceramic cylinder.

Figure 2:
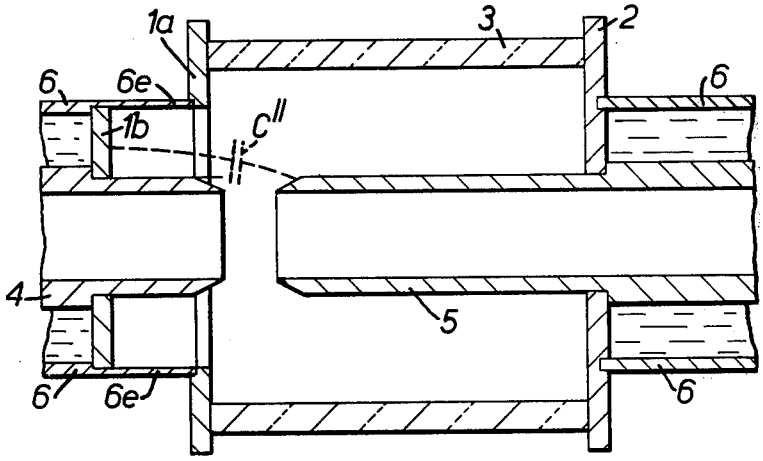

FIG. 1 is a longitudinal section taken through a portion of a conventional klystron tube; and FIG. 2 is a longitudinal section taken through a portion of a klystron type cavity tube according to this invention.

The invention is further described with reference to FIG. 2 of the accompanying drawing which illustrates the resonant cavity portion of one klystron tube in accordance with the present invention.

In FIG. 2, like references are used for like parts in FIG. 1.

Referring to FIG. 2, it will be seen that the difference between the tube as illustrated in FIG. 2 and that illustrated by FIG. 1, resides principally in the nature of one of the end walls 1 of the resonant cavity portion of the tube. In the case of FIG. 2, the end wall 1 is formed so that one part 1*b* thereof (that part through which the drift tube portion 4 passes) is further from the end of drift tube portion 5 than another part 1*a* to which the ceramic cylinder 3 is attached. The end wall 1 in this case is, in fact, made up of two annular washers, the smaller one forming wall portion 1*b* and the larger forming wall portion 1*a*. The two portions are united by an extension 6*e* of the coolant jacket 6.

The effect of this construction is to reduce the capacitance $c''$ between the end of the drift tube portion 5 and the surface of the wall 1 and so tend to raise the resonant frequency of the tube.

Although in the embodiment illustrated in FIG. 2 only wall 1 is formed as described above, as will be appreciated it is possible to provide both walls 1 and 2 of such form. Also the invention is illustrated as being applied to an external cavity klystron tube provided to have a resonator box (not shown) fitted around the ceramic cylinder 3. As will be appreciated the invention is also applicable to klystrons of integral cavity construction and may be applied to any number of cavities in the tube, back-to-back in adjacent cavities if necessary where a very short drift tube is required.

I claim:

1. A klystron type resonant cavity tube comprising two spaced cavity forming walls, a portion of a first drift tube extending through one of said cavity forming walls, a second portion of a drift tube extending through the other of said cavity forming walls, said two drift tube portions extending towards one another along a common axis to end within the cavity of which said walls form part and define a gap therebetween, and at least one of said two cavity forming walls having an inner part through which passes said first drift tube portion and having a radially outer part which is spaced closer along said axis from the end of said second drift tube portion than is said inner part of said one wall, said inner part being spaced axially from said gap by an amount sufficient to mitigate reduction in resonant frequency of the tube caused by the axial dimension of said gap.

2. A tube as claimed in claim 1 and wherein said inner and outer parts of said one wall are discreet wall portions which are united by an extension of a coolant jacket surrounding said first drift tube portion.

3. A tube as claimed in claim 1 and wherein said tube is of the external cavity type.

4. A tube as claimed in claim 1 and wherein said tube is of the integral cavity type wherein the cavity defined by said cavity forming walls comprises the total extent of the resonant cavity volume in that part of the tube.

5. A tube as claimed in claim 3 and wherein a dielectric cylinder extends between said two walls to form a vacuum chamber which is provided to couple with a resonator box fitted around said cylinder.

6. A tube as claimed in claim 5 and wherein said dielectric cylinder is a ceramic cylinder.

7. A klystron type resonant cavity tube comprising, in combination:

first and second end walls defining part of a resonant cavity;

a first drift tube portion extending centrally through said first end wall and a second drift tube portion extending centrally through said second end wall, said drift tube portions being axially aligned and presenting spaced, adjacent end portions defining a gap therebetween; and means for allowing said gap to be narrow without causing corresponding reduction in the resonant frequency of the tube, said means comprising axially spaced inner and outer portions of at least said first end wall, said outer portion being of annular form and being spaced a predetermined axial distance from said gap, and said inner portion also being of annular form and being spaced axially from said gap by an amount sufficiently greater than said predetermined distance as to mitigate reduction in resonant frequency due to the narrowness of said gap.

* * * * *